US009834337B2

(12) United States Patent
Roehm

(10) Patent No.: US 9,834,337 B2
(45) Date of Patent: Dec. 5, 2017

(54) SYSTEM MODULE

(75) Inventor: Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 575 days.

(21) Appl. No.: 14/342,558

(22) PCT Filed: Jul. 13, 2012

(86) PCT No.: PCT/EP2012/063785

§ 371 (c)(1),
(2), (4) Date: Jun. 20, 2014

(87) PCT Pub. No.: WO2013/034340

PCT Pub. Date: Mar. 14, 2013

(65) Prior Publication Data

US 2014/0291319 A1 Oct. 2, 2014

(30) Foreign Application Priority Data

Sep. 6, 2011 (DE) ..... 10 2011 082 151

(51) Int. Cl.

| | |
|---|---|
| ***A47G 19/00*** | (2006.01) |
| ***B65D 25/10*** | (2006.01) |
| ***B25H 3/02*** | (2006.01) |
| ***B65D 69/00*** | (2006.01) |

(52) U.S. Cl.

CPC ..... *B65D 25/10* (2013.01); *B25H 3/02* (2013.01); *B65D 69/00* (2013.01)

(58) Field of Classification Search

CPC ..... B65D 25/10; B65D 69/00; B25H 3/02
USPC ..... 206/372, 349, 373, 774, 736; 220/23.86
See application file for complete search history.

(56) References Cited

U.S. PATENT DOCUMENTS 5,169,018 A 12/1992 Fiore
5,325,966 A * 7/1994 Chang ..... B65D 21/02 206/349
5,676,254 A * 10/1997 Cheng ..... B25H 3/021 206/373
5,915,554 A * 6/1999 Hung ..... B65D 51/002 206/372

(Continued)

FOREIGN PATENT DOCUMENTS

CN 1123509 C 10/2003
CN 101837854 A 9/2010

(Continued)

OTHER PUBLICATIONS

International Search Report corresponding to PCT Application No. PCT/EP2012/063785, dated Oct. 22, 2012 (German and English language document) (7 pages).

*Primary Examiner* — Fenn C Mathew
*Assistant Examiner* — Don M Anderson
(74) *Attorney, Agent, or Firm* — Maginot, Moore & Beck LLP

(57) ABSTRACT

A system module for a storage system with at least one frame unit. The system module includes at least one coupling unit for coupling to at least one additional system module. The coupling can be disengaged by a user. The system module also includes at least one functional unit that can be positioned at least substantially inside a space spanned by the frame unit, The system module also includes at least one positioning unit, which is configured to position the functional unit relative to the frame unit in at least two at least substantially different positions.

16 Claims, 2 Drawing Sheets

(56) References Cited

U.S. PATENT DOCUMENTS

| | | | | |
|---|---|---|---|---|
| 6,000,572 | A | 12/1999 | Kako et al. | |
| 6,176,593 | B1 * | 1/2001 | Spitler | B25H 3/02 362/154 |
| 6,626,295 | B1 | 9/2003 | Vasudeva | |
| 2003/0015445 | A1 | 1/2003 | Levy | |
| 2003/0094392 | A1 | 5/2003 | Meier et al. | |
| 2006/0108245 | A1 * | 5/2006 | Lee | B25H 3/023 206/373 |
| 2014/0069832 | A1 * | 3/2014 | Roehm | B25H 3/02 206/349 |
| 2014/0076759 | A1 * | 3/2014 | Roehm | B25H 3/026 206/372 |

FOREIGN PATENT DOCUMENTS

| | | | |
|---|---|---|---|
| CN | 102814801 | A | 12/2012 |
| DE | 42 01 264 | A1 | 7/1993 |
| DE | 197 06 413 | A1 | 8/1998 |
| DE | 203 14 301 | U1 | 4/2004 |
| DE | 20 2006 010 566 | U1 | 11/2006 |
| DE | 10 2008 058 007 | B3 | 4/2010 |
| EP | 2 189 381 | A1 | 5/2010 |
| FR | 2 942 444 | A1 | 8/2010 |
| TW | 493512 | U | 7/2002 |
| WO | 02079043 | A2 | 10/2002 |

* cited by examiner

SYSTEM MODULE

This application is a 35U.S.C. §371National Stage Application of PCT/EP2012/063785, filed on Jul. 13, 2012, which claims the benefit of priority to Ser. No. DE 10 2011 082 151.1, filed on Sep. 6, 2011in Germany, the disclosures of which are incorporated herein by reference in their entirety.

The disclosure proceeds from a system module which belongs to a case system and is provided to be coupled to at least one further system module.

BACKGROUND

DE 10 2008 058 007 B3 has already proposed a system case having at least one housing element which comprises a coupling device for user-releasable coupling to a further system case. Cases having a functional unit other than a hand tool are also known.

SUMMARY

The disclosure proposes a system module of a storage system, having at least one frame unit, having at least one coupling unit, which is provided for user-releasable coupling to at least part of at least one further system module, having at least one functional unit, which is arranged, at least predominantly, within a space defined by the frame unit, and having at least one positioning unit, which is provided to position the functional unit relative to the frame unit in at least two at least essentially different positions.

"System module" is intended to mean, in particular, a module which at least one accommodating region for accommodating at least one article, in particular for transporting the at least one article, wherein the system module is provided to interact with at least one further system module for the purpose of achieving functionality, in particular at least convenient transportation. The system module according to the disclosure preferably encloses the accommodating region, in particular over a single plane, on at least four sides. The system module according to the disclosure preferably encloses the accommodating region over a single plane through at least 270 degrees, particularly preferably through 360 degrees.

"Provided" is intended to mean, in particular, specifically designed and/or equipped.

"Storage system" here is intended to mean a system that comprises in particular at least two, preferably at least three and particularly preferably four or more, system modules and is provided to store or to transport in particular hand tools, hand-held power tools and/or accessory parts. Further functions of the storage system which appear to be expedient to a person skilled in the art are also conceivable. In a particularly preferred exemplary embodiment, the storage system is configured such that it can be extended as desired by means of further system modules. The system modules may preferably be formed by a frame, a case, a rack or similar elements which appear to be expedient to a person skilled in the art and are configured to be compatible in relation to the storage system.

"Frame unit" here is intended to mean, in particular, a unit which has at least three side elements which form a contour, in particular a closed contour, and enclose a defined space. A particularly preferred exemplary embodiment provides for four interlinked side elements arranged in particular perpendicularly to one another. Preferably at least one of the two further sides, which are arranged perpendicularly to the at least three, in particular four, side walls, are configured to be open, wherein "configured to be open" here is intended to mean, in particular, that the frame unit has been designed intentionally without a base element and/or cover element. It is particularly preferable for the frame unit to be configured at least essentially in one piece. The frame unit preferably has a frame element made of a metal and/or particularly preferably made of a plastics material, such as in particular PA6, ABS, PC, PP and/or some other plastics material which appears to be expedient to a person skilled in the art. In a particularly preferred exemplary embodiment, the frame unit encloses a functional-unit-accommodating region for accommodating a functional unit at least in part. The frame unit, when used as intended, in particular for transporting an article in the accommodating region, for storage and for stacking purposes, is preferably at least essentially dimensionally stable. This means, in particular, that the frame unit, when used as intended is, in particular, elastically deformed by less than 20%, advantageously by less than 5%, of a main extent of the frame unit. The frame unit preferably has at least one standing surface, which is provided to allow the unit to stand in a reliable manner at least on a slanting plane which has a slope of at least 10 degrees. Preferably at least the standing surface is of non-slip and/or preferably impact-protected configuration. The frame unit makes it possible for the functional unit, in an installed state, to be advantageously protected, in a constructionally straightforward manner, against mechanical action.

"Coupling unit" here is intended to mean a unit which is provided to connect, in particular to latch, relative to one another, in at least one operating state, the system module according to the disclosure and at least one further system module. The coupling unit particularly preferably comprises at least one coupling element. In a particularly preferred exemplary embodiment, the coupling unit comprises at least two, preferably at least three and particularly preferably at least four, coupling elements. The coupling elements are configured preferably such that they differ from one another. This makes it possible to achieve an advantageously high level of flexibility and a practical way of assembling the at least two system modules of the storage system.

In particular, "user-releasable coupling" is intended to mean a mechanical connection which can be released and/or opened in particular in a non-destructive manner by a user for the purposes of spatially separating the system module according to the disclosure and the at least one further system module. The user can preferably release the coupling without using any tools.

"Functional unit" is intended to mean, in particular, a unit which is provided to perform a main function in an operating state, in particular in a state in which the functional unit is fastened at least essentially in the frame unit and/or is connected to the frame unit. The functional unit is configured such that it differs, preferably at least essentially from a hand tool and/or from a hand-powered machine tool. The functional unit preferably has at least one function which appears to be expedient to a person skilled in the art. The functional unit may advantageously comprise at least one lighting means, a charger, a measuring instrument, a leveling device, an energy output, in particular a plug receptacle, a vacuum cleaner and/or a media-playback unit, in particular a radio.

In particular, the expression "space defined" here is intended to mean the space which is defined by a contour of the frame unit. The space is particularly preferably open on at least one side, preferably on at least two sides, in particular on two opposite sides, and is at least essentially freely accessible for a user, and therefore the functional unit can be inserted into the space in particular without any tools being used. It is particularly preferable for the functional unit, in an inserted, ready-for-operation state, to be arranged at least in part advantageously at least essentially in its entirety, within the space defined by the frame unit.

"Positioning unit" here is intended to mean, in particular, a unit which is at least essentially provided to position the functional unit relative to the frame unit in at least two different positions. The positioning unit is connected in particular in a releasable manner, preferably to the functional unit and/or the frame unit. In a particularly preferred exemplary embodiment, at least part of the positioning unit at least essentially constitutes a connection between the functional unit and the frame unit. The positioning unit is preferably connected in a movable manner to the functional unit and/or the frame unit. In a particularly preferred exemplary embodiment, the positioning unit is connected to the functional unit and/or the frame unit such that it can be moved preferably in a rotary and/or translatory manner relative to the functional unit and/or the frame unit. It is particularly preferable to provide at least two arresting positions for at least part of the positioning unit, in order to achieve, and retain, in an installed state of the functional unit, at least two positions of the functional unit relative to the frame unit. The at least two arresting positions can be achieved preferably by means of a friction fit, by means of latching elements or other methods which appear to be expedient to a person skilled in the art.

In a particularly preferred exemplary embodiment, the positioning unit is provided to achieve at least three, preferably at least four, and particularly preferably at least five, different positions of the functional unit relative to the frame unit. It is particularly preferred for it to be possible to achieve, by means of the positioning unit, any desired number of positions of the functional unit relative to the frame unit within a defined range. It is additionally possible to achieve a situation where, in a first position of the functional unit relative to the frame unit, at least one additional element in particular of the functional unit, for example in the form of wheels, operating elements, functional elements and/or the like, to be concealed and freed in at least one second position.

"At least essentially different positions" here is intended to mean, in particular, a deviation of the at least two positions by at least 1 mm, preferably by at least 5 mm and particularly preferably by at least 10 mm, in at least one direction in space, preferably in at least two, and particularly preferably in three, directions in space. In a particularly preferred exemplary embodiment, the deviation of a first position from at least one second position is at least 25 mm.

The configuration according to the disclosure makes it possible for a user to position the functional unit in adaptation to the respective use, wherein the frame unit can advantageously maintain a reliable standing position for the system module. The configuration of the system module according to the disclosure can thus achieve, in particular, a high level of flexibility and advantageous ease of operation for a user. In addition an advantageously high level of protection of the functional unit, in particular against impact, can be achieved by the frame unit in an installed state. This makes it possible to achieve a particularly high level of robustness for the system module according to the disclosure.

In a further configuration, it is proposed that, in a first position, the functional unit at least essentially completely fills the space defined by the frame unit. "At least essentially" here is intended to mean, in particular, that the functional unit fills at least up to 50%, preferably at least up to 70% and particularly preferably up to at least 80%, of the space defined by the frame unit. In a particularly preferred exemplary embodiment, the functional unit fills at least up to 95% of the space defined by the frame unit. This makes it possible to achieve an advantageously compact and space-saving configuration of the system module according to the disclosure.

In addition, it is proposed that the at least one positioning unit is connected to the functional unit and the frame unit. In particular, it is possible for the positioning unit to be provided as a connecting element between the functional unit and the frame unit. In a particularly preferred exemplary embodiment, the positioning unit is connected in a releasable manner to the functional unit and the frame unit. This makes it possible to achieve advantageously convenient fastening of the functional unit and of the frame unit to one another, wherein it is additionally possible to achieve preferably straightforward and convenient positioning in at least two at least essentially different positions of the functional unit relative to the frame unit.

It is also proposed that the positioning unit has at least one pivoting element, which is provided to connect the frame unit and the functional unit to one another. The pivoting element is preferably connected to the functional unit and/or the frame unit such that it can be moved in particular in a rotary and/or translatory manner relative to the functional unit and/or the frame unit. This makes it possible to achieve particularly straightforward and convenient positioning in at least two at least essentially different positions of the functional unit relative to the frame unit. The pivoting element additionally makes it possible to achieve an advantageously high level of stability of the functional unit relative to the frame unit in different positions.

It is also proposed that the frame unit and the functional unit are mounted such that they can be pivoted relative to one another about at least one axis. The at least one axis may be arranged in particular parallel to a main direction of the extent of the frame unit. This makes it possible to achieve constructionally straightforward positioning of the functional unit relative to the frame unit. As an alternative, or in addition, it is also conceivable for the functional unit to be brought into at least two different positions relative to the frame unit by a translatory movement, in particular by a parallel displacement.

It is also proposed that the functional unit and the frame unit are connected to one another in an at least essentially releasable manner.

"Releasable" here is intended to mean, in particular, "such that they can be separated in a non-destructive manner". In particular it is possible for the frame unit and the functional unit to be connected to one another such that they can be released without any tools being used. This makes it possible for a user to replace the functional unit in an advantageously straightforward manner in particular by a further functional unit, as a result of which it is possible to achieve an advantageously high level of flexibility.

It is also proposed that the at least one coupling unit comprises at least one latching element. A "latching element" here is intended to mean, in particular, an element which is deflected elastically during a fastening operation, in order then to latch in, by way of a tensioning force, behind a corresponding latching element, which may be formed in particular by a protrusion, a recess or some other element which appears to be expedient to a person skilled in the art. It is also possible for the coupling unit to comprise as an alternative, or in addition, at least one corresponding latching element, which may be formed in particular by a protrusion, a recess or some other element which appears to be expedient to a person skilled in the art. This makes it possible to achieve a situation where the system module according to the disclosure can be coupled to at least part of at least one further system module in a constructionally straightforward manner which allows release in particular without any tools being used.

It is also proposed that the at least one coupling unit has at least one sliding-guide element. A "sliding-guide element" here is intended to mean, in particular, an element which is provided to achieve in particular linear guidance of the system module according to the disclosure. The sliding-guide element preferably forms an at least essentially, at least part of a sliding guide. The sliding-guide element may be formed by a guide groove. It is thus possible for the system module, in a manner similar to a drawer, advantageously to be integrated into the storage system, in particular into a system rack. This makes it possible to achieve the situation where the system module according to the disclosure can be coupled to at least part of at least one further system module in a constructionally straightforward manner which allows release in particular without any tools being used.

As an alternative, or in addition, the coupling unit could have further coupling elements which appear to be expedient to a person skilled in the art.

Further advantages can be gathered from the following description of the drawings. The drawings illustrates an exemplary embodiment of the disclosure. The drawings, the description and the claims contain numerous features in combination. A person skilled in the art will expediently also view the features individually and combine them to form expedient further combinations.

DETAILED DESCRIPTION

Figure 1:
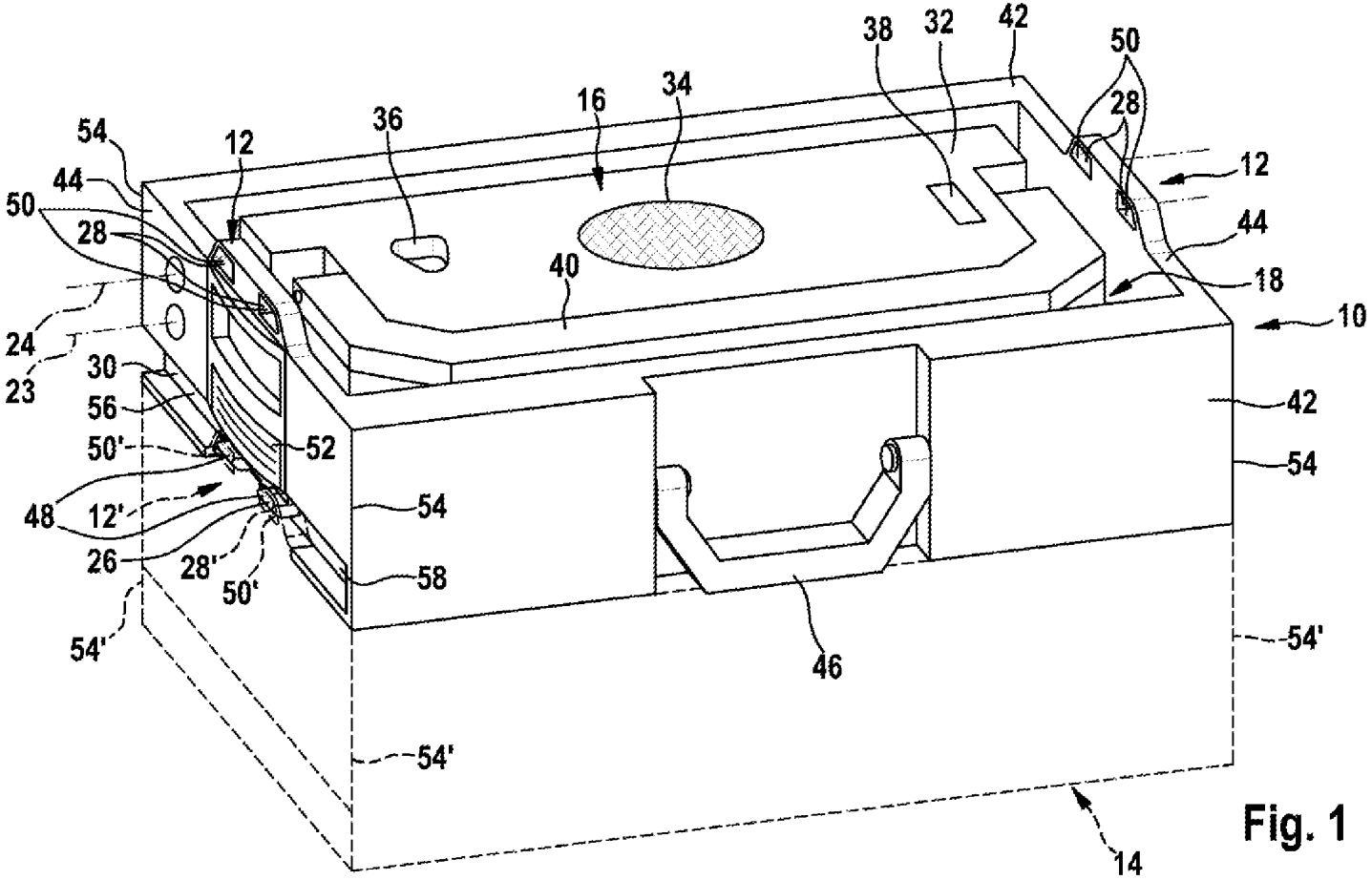
FIG. 1 shows a perspective illustration of a system module having a frame unit and having a functional unit in a first position.

FIG. 1 shows a perspective illustration of a system module according to the disclosure, the system module belonging to a storage system having a frame unit 10 and having a functional unit 16. The functional unit 16 comprises a piece of electrical equipment 32. The piece of electrical equipment 32 is formed by a lamp. The piece of electrical equipment 32 comprises a lighting means 34. The functional unit 16 has a mechanical and/or electrical interface 36. The interface 36 is compatible with a storage-battery pack (not illustrated) in particular of a hand-held power tool, with an electric plug or with some other element which appears to be expedient to a person skilled in the art. In addition, the functional unit 16 has an operating element 38, which serves for actuating the piece of electrical equipment 32.

In addition, the functional unit 16 comprises a handle 40. The handle 40 is arranged on a side of the functional unit 16 which, in an installed state, is arranged perpendicularly to side walls 42, 44 of the frame unit 10. The handle 40 is provided for the purpose of carrying the functional unit 16 or the system module horizontally. The handle 40 is mounted in a pivotable manner. For horizontal carrying purposes, the handle 40 is pivoted out of a space 18 defined by the frame unit 10. In a pivoted-out state, the handle 40 is fixed in a releasable manner in a pivoting direction by the user.

The frame unit 10 encloses the functional unit 16 on four sides. On these sides, the frame unit 10 has the side walls 42, 44. The side walls 42, 44 are formed from a plastics material. Two further sides of the frame unit 10 which have the largest surface-area extent, are designed to be open. It is also conceivable, however, as an alternative or in addition, for a cover and/or a base to be provided on these sides. The side walls 42, 44 define the space 18. In the installed state illustrated, the functional unit 16 is arranged entirely within the defined space 18.

The frame unit 10 has a handle 46. The handle 46 is provided for the purpose of carrying the frame unit 10 or the system module horizontally. The handle 46 is mounted in a pivotable manner on one side wall 42 of the four side walls 42, 44. As an alternative, the handle 46 could be formed in one piece with the frame unit 10 or with the side wall 42. The frame unit 10 is provided such that it can be set down on the side directed away from the handle 46. This side wall 42 is coated, in a manner which is not illustrated specifically here, in an impact-reducing and non-slip manner, in particular with a rubber material.

It is also the case that the frame unit 10 of the two side walls 44, which have the smallest surface area extent, comprises in each case one coupling unit 12. The coupling units 12 are configured to be at least essentially identical and in mirror-inverted arrangement in relation to one another. The coupling unit 12 is provided in each case for coupling to at least part of at least one further system module 14, for example a tool case or a further frame structure. The coupling unit 12 is configured in each case at least partially in one piece with the frame unit 10. The coupling by the one coupling unit 12 in each case is configured such that it can be released by a user. Each coupling unit 12 comprises a plurality of coupling elements. Each coupling unit 12 comprises two latching elements 26, 28, wherein the first latching element 26 is configured such that it can be deflected elastically and the second latching element 28 is designed to correspond to the first latching element 26. The first latching element 26 is designed as a latching hook 48. The latching hook 48 can be deflected resiliently. The latching hook 48 is mounted in a resilient manner. The second latching element 28 is designed as a recess 50. The first latching element 26 of the first system module, in a latched-in state, engages in the second latching element 28 of the second system module and thus establishes a releasable, force-fitting connection between the at least two system modules. In addition, the coupling unit 12 has a respective operating element 52.

FIG. 1 uses dashed lines to illustrate, schematically, the further system module 14, which is coupled to the system module according to the disclosure. The latching elements 26 of the coupling unit 12 for the system module, the latching elements 26 being designed as latching hooks 48, engage here in latching elements 28' of a coupling unit 12' of the further system module 14, the latching elements 28' being formed by recesses 50'. The coupling is designed such that a user can release it without using any tools. For this purpose, the user can move the latching elements 26 inwards by virtue of pushing the operating element 52 for the purpose of releasing the coupling, as a result of which the latching elements 26, which are designed as latching hooks 48, unlatch from the latching elements 28' of the coupling unit 12' of the further system module 14, the latching elements 28' being designed as recesses 50'.

The system module and the further system module 14 are coupled to form a stack. In a coupled state of operation, four edges 54 of the system module run at least essentially along the same straight lines as four edges 54' of the further system module 14. An outer plane defined perpendicularly to the side walls 42, 44 of the frame unit 10 of the system module lies flush against an outer plane of the further system module 14. The system module and the further system module 14 here form at least part of the storage apparatus. The storage apparatus can be extended as desired by further system modules which are of any desired configuration, but correspond.

In addition, the coupling unit 12 has a respective sliding-guide element 30. The sliding-guide element 30 is designed as a guide groove 56. The guide groove 56 is provided to correspond with a corresponding sliding-guide element (not illustrated) of an element of the storage system. The corresponding element of the storage system may be formed here by a system rack. The guide groove 56 terminates in a stop 58, which limits a push-in path during a linear sliding movement of the system module along the corresponding sliding-guide element. The sliding-guide element 30 is made in one piece in the side wall 44 of the frame unit 10.

FIG. 1 shows the system module in a transportation state, which defines a first position. In the transportation state shown, a plane in which the functional unit 16 has its largest surface-area extent and a plane which extends perpendicularly to the side walls 42, 44 of the frame unit 10 are arranged parallel to one another.

In the transportation state, the functional unit 16 is arranged entirely within the space 18 defined by the frame unit 10 and at least essentially completely fills this space.

Figure 2:
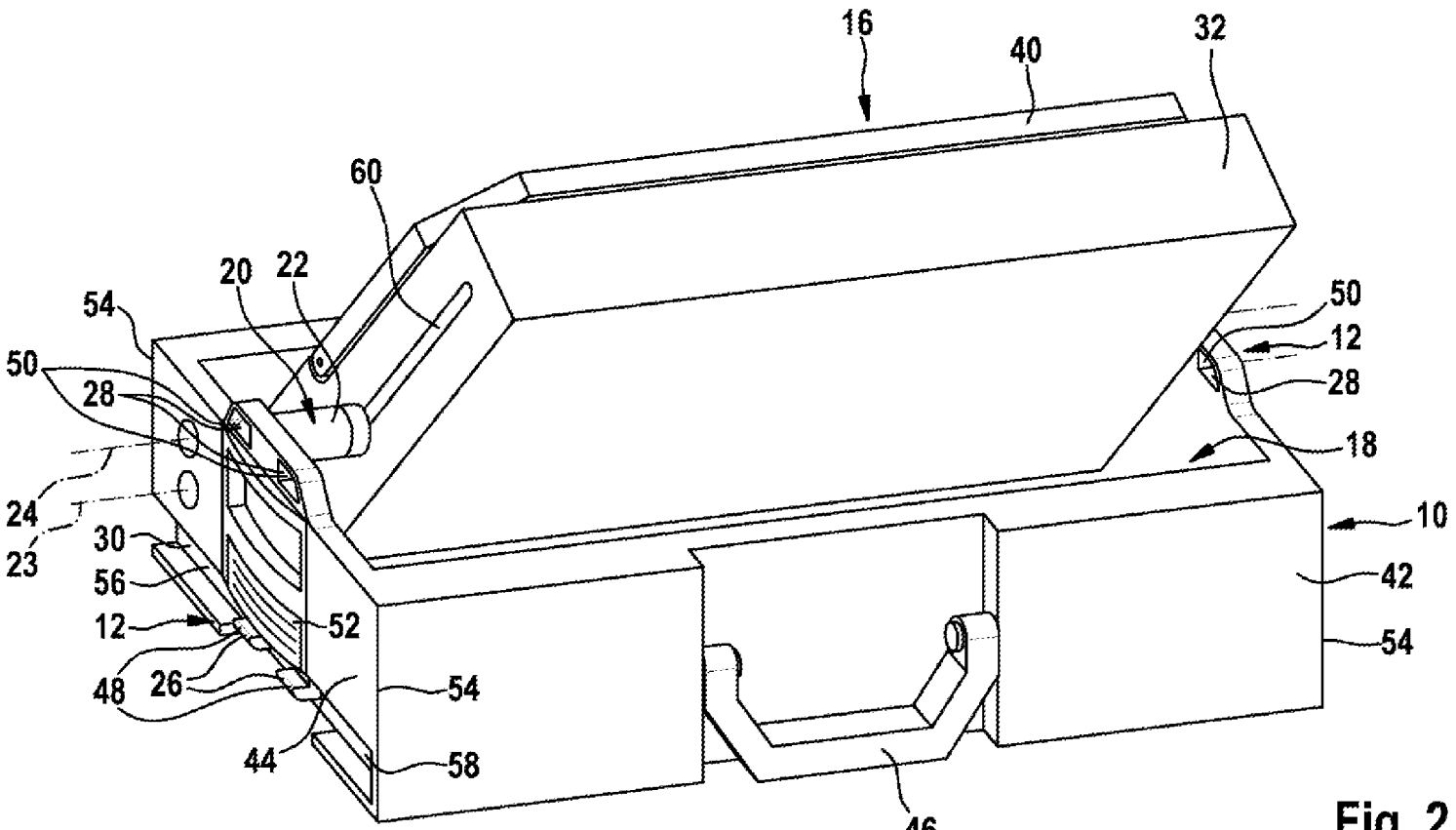
FIG. 2 shows the system module having the frame unit and the functional unit in a second position.

FIG. 2 shows the system module with the functional unit 16 arranged in a second position, which is different to the transportation state, relative to the frame unit 10. For this purpose, the system module has a respective positioning unit 20 on two opposite side walls 44 of the frame unit 10. The positioning units 20 are fastened on the same side walls 44 of the frame unit 10 on which the respective coupling unit 12 is also arranged. In alternative exemplary embodiments, it is possible for the positioning units 20 to be fastened on the side walls 42 of the frame unit 10, these side walls 42 then having, in particular, no coupling unit.

The positioning unit 20 comprises a pivoting element 22. The pivoting element 22 is mounted on the frame unit 10 at a first end, as seen in the longitudinal direction, such that it can be rotated about an axis 24. At a second end of the pivoting element 22, said end being directed away from the first end, the pivoting element 22 is connected to the functional unit via a linear guide. For this purpose, in an installed state, a stub (not illustrated) of the pivoting element 22 engages in a slot-like aperture 60 of the positioning unit 20 and is guided therein. By means of the pivoting element 22, the positioning unit 20 connects the functional unit 16 and the frame unit 10 to one another in particular in a releasable manner.

In an installed state, there is a friction fit between the stub of the pivoting element 22 and the slot-like aperture 60 of the functional unit 16, and therefore the functional unit 16, in the absence of the action of an external force, for example applied by a user, maintains the current position, i.e. can be set in position, relative to the frame unit 10. If a user applies a force to the functional unit 16 and/or frame unit 10, then it is possible to eliminate the friction fit and to change a position of the functional unit 16 relative to the frame unit 10. The friction fit between the stub of the pivoting element 22 and the slot-like aperture 60 of the functional unit 16 makes it possible to achieve stepless positioning of the functional unit 16 relative to the frame unit 10. As an alternative, or in addition, it is also conceivable to provide a plurality of latching steps for positioning the functional unit 16 relative to the frame unit 10.

If a user applies, to the functional unit 16 and/or frame unit 10, force which has at least one component perpendicular to the axis 24, it is possible for the position of the functional unit 16 relative to the frame unit 10 to be adjusted in the manner which the user deems to be expedient or practical for the use in question. The functional unit 16 here is pivoted relative to the frame unit 10 about the axis 24. The stub of the pivoting element 22 slides, at the same time, in the slot-like aperture 60. It is thus possible, for example, for the piece of electrical equipment 32 formed by the lamp to be directed precisely, by the user, at the user's workstation. It is likewise conceivable to provide an operating element (not illustrated) by means of which a user can release and/or change the respective position of the functional unit 16 relative to the frame unit 10.

The invention claimed is:

1. A modular storage unit of a storage system, comprising:

at least one frame unit that includes an inner side contour that laterally surrounds an internal space and forms an open structure such that the only surface of the at least one frame unit facing toward the internal space is the inner side contour;

at least one coupling unit that is disposed on the at least one frame unit and that includes a first coupling element and a second coupling element that corresponds with the first coupling element such that;

the first coupling element is configured to engage with a second coupling element of a similarly configured coupling unit of a first further modular storage unit to releasably couple the modular storage unit to the first further modular storage unit, wherein releasing the first coupling element from the second coupling element of the first further modular storage unit completely separates the modular storage unit from the first further modular storage unit; and the second coupling element is configured to engage with a first coupling element of a similarly configured coupling unit of a second further modular storage unit to releasably couple the modular storage unit to the second further modular storage unit, wherein releasing the second coupling element from the first coupling element of the second further modular storage unit completely separates the modular storage unit from the second further modular storage unit;

at least one functional unit embodied as an electrical device that, in an operative state, is configured to perform at least one function; and at least one positioning unit configured to mount the at least one functional unit in the at least one frame unit and enable the at least one function unit to move between at least:

(i) a first position whereat the electrical device is in a transportation state, and is arranged at least essentially within the interior space, and (ii) a second position whereat the electrical device is in the operative state and is arranged so as to be at least partially outside of the internal space.

2. The modular storage unit as claimed in claim 1, wherein, in the first position, the at least one functional unit at least essentially completely fills the internal space defined by the at least one frame unit.

3. The modular storage unit as claimed in claim 1, wherein the at least one positioning unit is connected to the at least one functional unit and to the at least one frame unit.

4. The modular storage unit as claimed in claim 1, wherein the at least one positioning unit has at least one pivoting element configured to connect the at least one frame unit and the at least one functional unit to each other.

5. The modular storage unit as claimed in claim 4, wherein the at least one frame unit and the at least one functional unit are mounted such that they are pivotable relative to each other about at least one axis.

6. The modular storage unit as claimed in claim 1, wherein the at least one functional unit and the at least one frame unit are releasably connected to each other.

7. The modular storage unit as claimed in claim 1, wherein the first coupling element includes at least one latching element.

8. The modular storage unit as claimed in claim 1, wherein the first coupling element includes at least one sliding-guide element that enables mounting the modular storage unit in a rack of the storage system.

9. A storage system comprising:

a plurality of modular storage units, each modular storage unit including:

at least one frame unit that includes an inner side contour that laterally surrounds an internal space and forms an open structure such that the only surface of the at least one frame unit facing toward the internal space is the inner side contour;

at least one coupling unit that is disposed on the at least one frame unit and that includes a first coupling element and a second coupling element that corresponds with the first coupling element such that;

the first coupling element is configured to engage with a second coupling element of a similarly configured coupling unit of another one of the plurality of modular storage units to releasably couple the modular storage unit to the other modular storage unit, wherein releasing the first coupling element from the second coupling element of the other modular storage unit completely separates the modular storage unit from the other modular storage unit; and the second coupling element is configured to engage with a first coupling element of a similarly configured coupling unit of a further one of the plurality of modular storage units to releasably couple the modular storage unit to the further modular storage unit, wherein releasing the second coupling element from the first coupling element of the further modular storage unit completely separates the modular storage unit from the further modular storage unit;

at least one functional unit embodied as an electrical device that, in an operative state, is configured to perform at least one function; and at least one positioning unit configured to mount the at least one functional unit in the at least one frame unit and enable the at least one function unit to move between at least:

(i) a first position whereat the electrical device is in a transportation state, and is arranged at least essentially within the interior space, and (ii) a second position whereat the electrical device is in the operative state and is arranged so as to be at least partially outside of the interior space.

10. The modular storage unit of claim 9, wherein the electrical device is a lighting device or a radio.

11. The storage system of claim 9, wherein, in the first position, the at least one functional unit of each modular storage unit at least essentially completely fills the internal space defined by the at least one frame unit of the modular storage unit.

12. The storage system of claim 9, wherein the at least one positioning unit of each modular storage unit is connected to the at least one functional unit and to the at least one frame unit of the modular storage unit.

13. The storage system of claim 9, wherein the at least one positioning unit of each modular storage unit has at least one pivoting element configured to connect the at least one frame unit and the at least one functional unit to of the modular storage unit each other.

14. The storage system of claim 13, wherein the at least one frame unit and the at least one functional unit of each modular storage unit are mounted such that they are pivotable relative to each other about at least one axis.

15. The storage system of claim 9, wherein the at least one functional unit and the at least one frame unit of each modular storage unit are releasably connected to each other.

16. The storage system of claim 9, wherein the first coupling element includes at least one of:

at least one latching element; and at least one sliding-guide element that enables mounting the modular storage unit in a rack of the storage system.

* * * * *